United States Patent [19]

Shira

[11] Patent Number: 4,768,787

[45] Date of Patent: Sep. 6, 1988

[54] GOLF CLUB INCLUDING HIGH FRICTION STRIKING FACE

[76] Inventor: Chester S. Shira, 3675 Ruffin Rd., Ste. 135, San Diego, Calif. 92123

[21] Appl. No.: 61,528

[22] Filed: Jun. 15, 1987

[51] Int. Cl.[4] ..... A63B 53/04

[52] U.S. Cl. ..... 273/175; 273/173

[58] Field of Search ..... 273/167 J, 173, 175, 273/78, 167 R, 167 B, 167 C, 167 F, 169, 171

[56] References Cited

U.S. PATENT DOCUMENTS

| | | | |
|---|---|---|---|
| 703,519 | 7/1902 | Becker | 273/173 |
| 1,289,553 | 12/1918 | Sanders | 273/175 |
| 3,989,861 | 11/1976 | Rasmussen | 273/167 J |
| 4,667,963 | 5/1987 | Yoneyama | 273/78 |

FOREIGN PATENT DOCUMENTS

| | | | |
|---|---|---|---|
| 2681181 | 7/1965 | Australia | 273/167 J |
| 52-26929 | 2/1977 | Japan | 273/167 J |
| 547946 | 9/1942 | United Kingdom | 273/78 |
| 1062796 | 3/1967 | United Kingdom | 273/167 J |

*Primary Examiner*—George J. Marlo
*Attorney, Agent, or Firm*—John L. Gray

[57] ABSTRACT

A golf club provided with a metallic golf ball striking surface wherein the striking surface has hard particles embedded therein with portions of the particles protruding above the surface so as to provide greater frictional grip between the golf ball striking surface and the golf ball. The striking surface of the golf club may be treated by various techniques so that the hard particles become embedded in the metallic matrix thus formed on the surface of the golf ball striking surface, or a separate formed metallic composite may be metallurgically bonded to the golf club head in the area of its surface which will contain the hard particles embedded therein with portions protruding above the surface.

5 Claims, 2 Drawing Sheets

GOLF CLUB INCLUDING HIGH FRICTION STRIKING FACE

BACKGROUND OF THE INVENTION

Golf clubs constituting the so-called "irons" comprise a series of clubs each club having a successively sloping striking surface which engages the golf ball. Thus, the golfer by using the same swing and force can vary the length of travel of the golf ball, depending upon the club that is selected, the higher numbered club having the greater slope to the ball striking surface. It is desirable that the ball striking surface of such clubs have high friction so that back spin is imparted to the golf ball at the time that it is struck so as to provide greater control over the ball after it has been hit so that the ball will attain the desired flight trajectory and the stopping or rolling distance of the ball will be minimized when desired.

At the present time this is accomplished by cutting grooves (usually horizontal) in the club head ball striking surface and decorative grit blasting or coating the surface with a hard particle bearing or plastic adhesive on the striking surface so as to provide greater friction between the ball and the striking surface at the moment of impact so as to impart backspin to the ball.

The disadvantage of golf club striking surfaces thus produced are that the friction surface has an extremely short life before it is worn down and the beneficial results are no longer achieved.

In the prior art there have been suggestions of adhering carbides and other hard particles to the striking surface of golf irons. For example, in Australian Pat. No. 268,181, Prince, et al., there is a disclosure of a metallic golf club head wherein a friction coating is placed on the striking surface of the golf club head using an epoxy resin, for example, in which powdered silicon, carbide, carborundum, etc. may be dispersed.

Japanese Pat. No. 52 26929, Miyama, discloses formation of a porous metal coating layer of metals of high melting point by the application of a plasma of flame-fusion process. Materials which may be used are metallic oxides, carbides, or silicides. On this layer a ceramic layer is added. The underlying layer must be porous in order successfully to bond to the ceramic layer. The porous ceramic layer then is immersed in a high elastic adhesive liquid plastic; for example, epoxy resin or polyurethane mixed with pigment to make it dry and hard.

SUMMARY OF THE INVENTION

The present invention invloves the creation of a ball striking surface on a metallic golf club which is a high friction surface that will permit long term use without deterioration of the friction causing elements in the surface. Specifically, the ball striking surface of the golf club has protruding therefrom hard sharp featured particles which will increase the friction between the ball striking surface of the golf club and the ball so as to impart maximum desired backspin on the ball.

It is therefore an object of this invention to provide a metallic golf ball striking surface wherein the hard protruding sharp featured particles are supported in a matrix of a softer metallic material which if it wears away through use, will continue to expose hard sharp featured particles embedded therein.

It is still another object of this invention to provide longer life of the high friction surface.

It is yet another object of this invention to provide a club head that will permit the player to have more repeatable, precise and predictable golf shots.

It is still another object of this invention to provide a golf club which will permit reduction of the skill level required for critical golf shots.

It is still another object of this invention to achieve accurate flight of the ball in golf shots.

It is still another object of this invention to provide less impact required on the part of the club to impart spin on golf balls.

It is still another object of this invention to provide high friction between the golf ball and the golf club striking surface under wet, dry, hot or cold conditions in the presence of contaminants such as mud, dirt, sand and grass.

It is still another object of this invention to provide high friction between the golf ball and the golf club striking surface on all golf ball surfaces, including balata and surylin covers.

These, together with other objects and advantages of the invention will become more readily apparent to those skilled in the art when the following general statements and descriptions are read in the light of the appended drawings.

DETAILED DESCRIPTION OF THE INVENTION

The hard sharp featured particles used in the instant invention may be selected from a variety of materials. Included among these materials are tungsten carbide, titanium carbide, vanadium carbide, silicon carbide, chrome carbide, boron carbide, complex carbides, ceramics, diamonds, beryllium compounds, boron compounds, alumina compounds, partially stabilized zirconia, naturally occurring minerals and laboratory created single crystal materials, such as sapphire, ruby and similar, and ion implantation. The golf club head itself may be used.

In the so-called "irons" golf club head, typically, the head is forged or precision cast iron, stainless steel, high strength steel, copper base alloys, cobalt base alloys and the like. Another metallic material or alloy such as copper, nickel, precious metals, brazing alloys or other soft metals, including low melting temperature metallic elements and alloys may be used on the striking surface of the golf club head, as hereinafter described. The thus improved surface may be used with or without conventional horizontal, or less conventional vertical grooves in the striking surface of the golf club head.

In such a composite surface the hard particles project or protrude slightly above the ball striking surface of the "iron" head and create friction between the club and the golf ball. Sharp features are desired to be maintained on the hard particles to maximize frictional forces even at low impact levels. Over an extended period of service, the matrix material will wear more rapidly than the hard particles, and the hard particles will continue to perform their friction creating function.

The surface roughness of the composite surface may be adjusted by use of well known selective etchants that remove matrix material without disturbing the hard particles. These etchants may be assisted by use of electrochemical processes, if desired, all well within the skill of a person skilled in the art.

Figure 1:
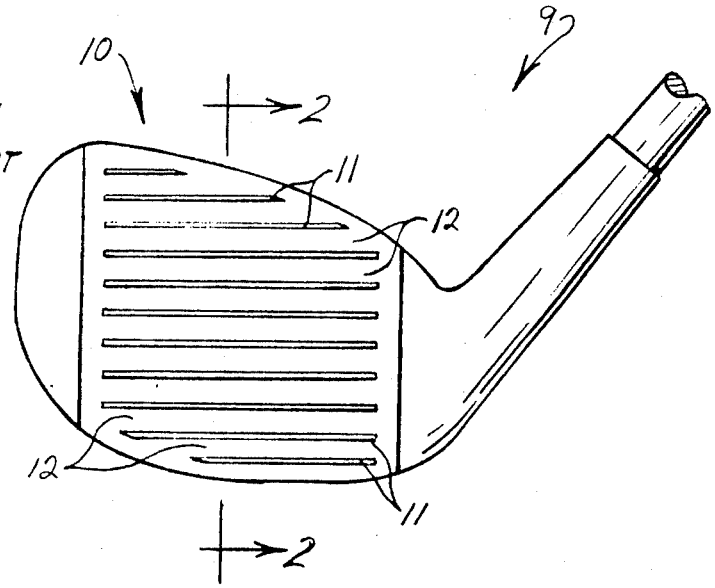
FIG. 1 PRIOR ART
FIG. 1 is a side elevation view of a metallic golf club showing the ball striking surface thereof.
Figure 2:
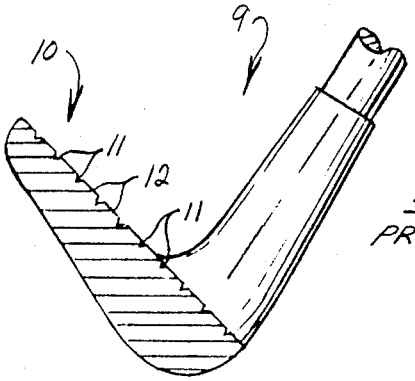
FIG. 2 PRIOR ART
FIG. 2 is a section of the golf club shown in FIG. 1.

Referring now more particularly to FIGS. 1 and 2, there is shown an "iron" golf club head 9 illustrating the current state of the art. The area designated 10 in FIG. 1 is provided with horizontally extending grooves 11-11, surfaces between the grooves having been grit blasted to provide a friction generating surface when the striking surface of the golf club head engages the ball.

Figure 3:
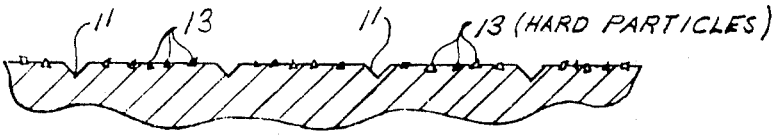
FIG. 3 is an enlarged view of FIG. 2 as modified by applicant's invention showing the hard particles of applicant's invention protruding above the striking surface of the golf club head.

FIG. 3 is an enlarged cross-sectional view of applicant's invention as applied to the striking surface of a golf club head. This is an enlarged view of the section shown in FIG. 2 disclosing applicant's invention as applied to the striking surface of a golf club head. Grooves 11-11 may be provided but the hard sharp particles 13-13 protrude slightly above the striking surface of the golf club head so as to firmly frictionally engage the golf ball during the moment of impact, thus imparting the appropriate backspin to the ball.

Figure 4:
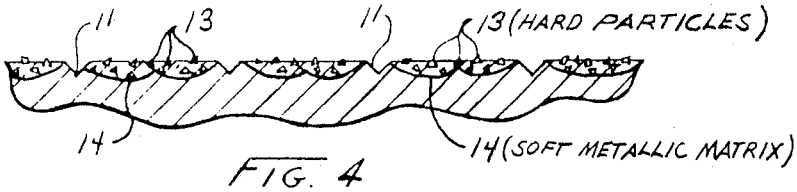
FIG. 4 is an enlarged view of the section shown in FIG. 3 wherein the hard particles have been embedded into the striking surface of the gulf club head by injection into areas which have been melted by a laser beam or other high energy density heat sources.

Referring now to FIG. 4, there is shown applicant's preferred method of creating a composite for the striking surface of the golf club head as is described in applicant's copending U.S. pat. application Ser. No. 061,527, entitled Implanting Sharp Edged Hard Particles in a Metal Matrix. A laser beam or other high energy source is used to melt the surface of the club in very small selected areas. By using this technique parallel grooves can be cut into the golf club head striking surface prior to the treatment with the alser beam or other high energy heat source, since the laser beam can be controlled to melt the area immediately between grooves as is shown in FIG. 4. Just before a molten puddle 14 freezes, a stream of hard sharp featured particles 13-13 is directed into the molten puddle 14. This stream is carried in a suitable gas such as carbon dioxide, argon, helium, nitrogen or the like. The particles thus injected are not subjected to the extreme heat of the heat source, nor are they in contact with the molten matrix material for more than an instant. Thus they retain their sharp corners, points, and other desirable friction creating features. Additionally, the stream of particles 13-13 can be directed to obtain a uniform distribution of particles 13-13 throughout the depth of the area being treated. The area is melted by the laser beam as shown at 14.

Figure 5:
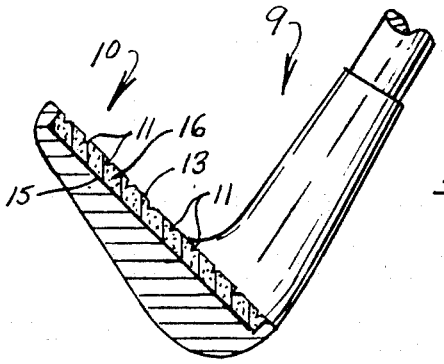
FIG. 5 is a sectional view similar to that shown in FIG. 2 as modified by applicant's invention wherein the hard sharp featured particles are distributed in a softer matrix material.

Referring now to FIG. 5, an area of the striking surface 10 of the club head 9 has been removed as shown at 15 and filled with a composite 16 comprising hard sharp featured particles 13-13 in a matrix material of a lower melting point than the club head 9 and hard particles 13-13. Using fluxing agents, including phosphorus, silicon, boron and more conventional brazing fluxes or suitable reducing inert or vacuum atmospheres, the components are heated to a temperature where the matrix material melts, wets and flows to bind the particles to the matrix and metallurgically bind the matrix to club head 9 and fill the area 15. An alternative to this method is to heat to a somewhat lower temperature and apply pressure to the composite or particles to induce bonding. This method is well known in the state of the art as pressing and sintering and also as diffusion bonding if the matrix material is the base metal. Some hard particles may resist being wetted by certain matrix materials at the desired processing temperatures and these may be treated beforehand by plating or coating the particles with an agent that will promote wetting or bonding. Common materials for this purpose are copper, nickel, gold and the like.

The depression 15 may be processed in the club head 9 by forging, casting, chemical, electro-chemical, or mechanical removal. The depression 15 is next coated with a layer of matrix metal and hard particles, singly or in combination. The hard particles are preferably from 60 to 325 mesh size and the matrix meatal may be in powder, shim or other suitable form. Furnace brazing binders may be used to position the particles and matrix materials and retain where desired during the handling and heating. If grooves are desired in the treated area, they may be formed prior to or after the heating operation. If additional hard particles are desired on the surface after furnace brazing, then an etchant can be selected to selectively remove desired amounts of matrix material without disturbing the hard particles.

Figure 6:
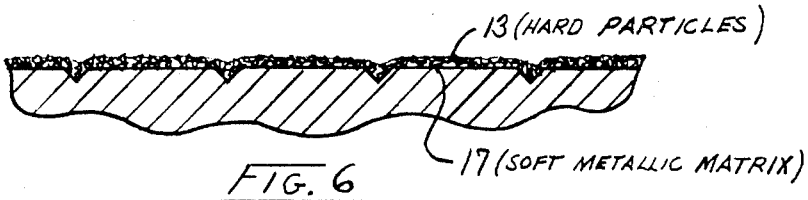
FIG. 6 is an enlarged cross-sectional view similar to that shown in FIG. 3 showing another method of attaching the hard sharp featured particles to the striking surface of the club head by use of a low melting temperature matrix material on the club head.

Referring now to FIG. 6, there is illustrated the use of a low melting temperature matrix metallic material 17 to bond hard particles 13-13 to the surface area of the club head.

Figure 7:
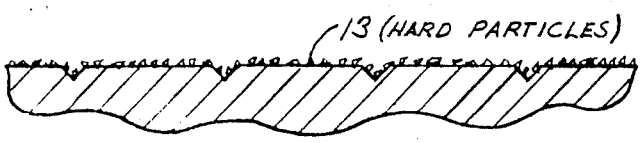
FIG. 7 is an enlarged cross-sectional view similar to FIG. 2 showing the hard sharp featured particles attached to the striking surface of the golf club head by means of flame spraying or similar surface attachment methods described in the specification.

Referring now to FIG. 7, the surface is shown with hard particles 13-13 attached by plasma, flame spraying or similar surface attachment as previously described.

Various methods of creating the desired surface include electron beam welding, furnace brazing, torch brazing, plasma spraying or welding, metal spraying, induction brazing, gas tungsten arc welding (GTAW), gas metal arc welding (GMAW), flux core arc welding (FCAW), submerged arc welding (SAW), shielded metal arc welding (SMAW), percussive discharge welding, chemical vapor depostion, ion bombardment, welding, or bonding a powder metallurgy insert in place, resistance welding a prepared insert in place, casting a club head around a prepared insert or preplaced particles, and other suitable methods.

When arc welding, using conventional and well known fabricated tubular welding rods consisting of iron or copper based tubing material and tungsten carbide particles contained there within, the heat of the arc partially melts the carbide particles enriching the matrix with tungsten and carbon and making it quite brittle, and reduces the size of the tungsten carbide particles making their external shape quite smooth and rounded.

The particles also tend to sink to the bottom of the weld making the surface not notably high in friction. By injecting the tungsten carbide particles into the freezing pool created by the laser beam or other suitable heat sources which exposes the particles to high heat of the molten matrix for only an instant and almost none of the direct heat of the laser beam, the slight amount of radiated and convection heat and the short exposure to molten matrix material are insufficient to round the carbide edges. Thus they retain their sharp, high friction creating features. The matrix material is not contaminated or comprised so it also retains its desirable properties. Further, injecting carbides into the freezing pool permits simple positional adjustment to assure the correct radio of hard particles embedded and exposed on the striking surface. Thus a variety of methods of making a high friction golf club striking surface have been described whereby a golf club striking surface having hard sharp featured particles protruding above the surface are created so as to impart greater friction between the striking surface of the golf club head and the golf ball.

While this invention has been described in its preferred embodiment, it is to be appreciated that variations therefrom may be made without departing from the true scope and spirit of the invention.

What is claimed:

1. A golf club provided with a metallic flat golf ball striking surface, said golf ball striking surface including a metallic matrix thereon containing hard particles which are harder than said metallic matrix and wherein portions of said particles protrude above said metallic matrix surface.

2. The golf club of claim 1 wherein said harder particles have sharp features protruding above said metallic matrix surface.

3. The golf club of claim 1 wherein said metallic matrix is metallurgically bonded to said golf club.

4. The golf club of claim 3 wherein said golf ball striking surface is provided with a composite of said softer metallic matrix material which is metallurgically bonded to said golf club and which in turn contains said harder particles.

5. The golf club of claim 3 wherein said softer metallic matrix material is bonded to the golf club ball striking surface and the harder particles are bonded into the metallic matrix material.

* * * * *

UNITED STATES PATENT AND TRADEMARK OFFICE

CERTIFICATE OF CORRECTION

PATENT NO. : 4,768,787

DATED : September 6, 1988

INVENTOR(S) : Chester S. Shira

It is certified that error appears in the above-identified patent and that said Letters Patent is hereby corrected as shown below:

Column 3, line 2: Insert before the words "be used" the words "function as the matrix material or other metallic elements may"

Column 3, line 56: Correct the spelling of the word "alser" beam to "laser".

Column 4, line 32: Correct the spelling of the word "meatal" to "metal:

Signed and Sealed this

Seventeenth Day of October, 1989

*Attest:*

*Attesting Officer*

DONALD J. QUIGG

*Commissioner of Patents and Trademarks*